US009701496B2

(12) United States Patent
Kim

(10) Patent No.: US 9,701,496 B2
(45) Date of Patent: Jul. 11, 2017

(54) CASSETTE DETECTION DEVICE

(71) Applicant: LG CNS Co., Ltd., Seoul (KR)

(72) Inventor: Sang Meen Kim, Seoul (KR)

(73) Assignee: LG CNS CO., LTD., Seoul (KR)

( * ) Notice: Subject to any disclaimer, the term of this patent is extended or adjusted under 35 U.S.C. 154(b) by 0 days.

(21) Appl. No.: 14/313,627

(22) Filed: Jun. 24, 2014

(65) Prior Publication Data

US 2014/0374985 A1 Dec. 25, 2014

(30) Foreign Application Priority Data

Jun. 25, 2013 (KR) ..... 10-2013-0073021

(51) Int. Cl.
*B65H 1/26* (2006.01)
*B65H 7/20* (2006.01)
(Continued)

(52) U.S. Cl.
CPC ..... *B65H 1/266* (2013.01); *B65H 7/20* (2013.01); *B65H 31/22* (2013.01); *B65H 31/24* (2013.01); *G07D 11/0006* (2013.01); *B65H 2402/62* (2013.01); *B65H 2511/20* (2013.01); *B65H 2511/30* (2013.01); *B65H 2511/40* (2013.01); *B65H 2557/30* (2013.01); *B65H 2701/1912* (2013.01)

(58) Field of Classification Search
CPC ..... B65H 2511/40; B65H 2511/30; B65H 2511/20; B65H 7/20; B65H 1/266; B65H 31/22; B65H 2402/62; B65H 2557/30
USPC ..... 271/145, 162, 164
See application file for complete search history.

(56) References Cited

U.S. PATENT DOCUMENTS 4,190,246 A * 2/1980 Sasuga ..... B65H 1/00 271/145
5,332,208 A * 7/1994 Tsuji ..... B65H 1/00 271/171

(Continued)

FOREIGN PATENT DOCUMENTS

CN 100407063 C 7/2008
CN 102025862 A 4/2011

(Continued)

OTHER PUBLICATIONS

Office Action dated Apr. 28, 2016 in Chinese Application No. 201410295036.7.

*Primary Examiner* — Patrick Cicchino
(74) *Attorney, Agent, or Firm* — Saliwanchik, Lloyd & Eisenschenk

(57) ABSTRACT

A cassette detection device may include: a cassette unit having one or more cassettes mounted therein, the one or more cassettes storing medium therein; a connector unit configured to receive a first signal corresponding to the case in which the one or more cassettes are mounted in the cassette unit or a second signal corresponding to the case in which the one or more cassette are not mounted in the cassette unit, from each of the one or more cassettes through one first transmission terminal; and a main board unit configured to detect one or more of whether and where each of the one or more cassettes is mounted, based on the first or second signal transmitted from the connector unit through a second transmission terminal at a connection position set for each of the one or more cassettes.

10 Claims, 4 Drawing Sheets

(51) Int. Cl.

| | |
|---|---|
| ***B65H 31/22*** | (2006.01) |
| ***G07D 11/00*** | (2006.01) |
| ***B65H 31/24*** | (2006.01) |

(56) References Cited

U.S. PATENT DOCUMENTS

| | | | | |
|---|---|---|---|---|
| 5,890,034 | A | 3/1999 | Nakano et al. | |
| 6,697,679 | B2 * | 2/2004 | Hatakeyama | G06K 15/16 271/8.1 |
| 7,027,765 | B2 * | 4/2006 | Han | B65H 3/44 271/9.01 |
| 7,397,576 | B2 * | 7/2008 | Hong | B65H 3/44 358/1.15 |
| 8,184,314 | B2 * | 5/2012 | Oh | B65H 3/44 358/1.13 |
| 8,864,125 | B2 * | 10/2014 | Mizuno | B65H 1/00 271/145 |
| 2003/0098540 | A1 * | 5/2003 | Hong | B65H 3/44 271/9.01 |
| 2004/0155396 | A1 * | 8/2004 | Han | B65H 3/44 271/9.01 |
| 2007/0001379 | A1 * | 1/2007 | Oh | B65H 3/44 271/145 |
| 2008/0174065 | A1 * | 7/2008 | Kita | B65H 3/44 271/258.01 |
| 2008/0292334 | A1 * | 11/2008 | Takahashi | B41J 11/0095 399/38 |
| 2011/0064504 | A1 * | 3/2011 | Kusumoto | G03G 15/5004 400/582 |
| 2013/0044164 | A1 | 2/2013 | Jia et al. | |
| 2013/0093442 | A1 | 4/2013 | Lee | |
| 2014/0307015 | A1 | 10/2014 | Nie et al. | |

FOREIGN PATENT DOCUMENTS

| | | | |
|---|---|---|---|
| CN | 102233737 | A | 11/2011 |
| CN | 102950902 | A | 3/2013 |
| JP | 07076426 | A * | 3/1995 |
| JP | 2009-211149 | A | 9/2009 |
| KR | 10-2006-0112827 | A | 11/2006 |
| KR | 10-2011-0012911 | A | 2/2011 |
| KR | 10-2013-0041614 | A | 4/2013 |

* cited by examiner

CASSETTE DETECTION DEVICE

CROSS-REFERENCES TO RELATED APPLICATION

This application claims the benefit under 35 U.S.C. §119 of Korean Patent Application No. 10-2013-0073021 filed Jun. 25, 2013, which is hereby incorporated by reference in its entirety.

BACKGROUND

Technical Field

Various embodiments relate to a cassette detection device, and more particularly, to a cassette detection device which transmits a signal, indicating whether a cassette is mounted in a cassette unit, to a main board unit through one transmission terminal (pin or the like) regardless of the number of cassettes, and determines whether and where the cassette is mounted.

Related Art

The term "medium" used in this specification may include bills, checks, tickets, certificates and the like, for example, and indicate various objects having a small thickness in comparison to the width or length thereof. In this specification, bills will be taken as an example of the medium, for convenience of description.

The medium handling apparatus is a device which receives and stores medium or releases the stored medium, and may store various medium having different sizes or thicknesses in a plurality of cassettes, respectively.

For example, when the medium handling apparatus includes four cassettes, 1,000-won bills, 5,000-won bills, 10,000-won bills, and 50,000-won bills may be stored in the respective cassettes. Each of the cassettes may be connected to a main board unit through a connector, and the main board unit may detect whether the cassette is mounted, according to whether the connector is connected.

In order to connect the cassettes to the main board unit, connectors and cables are used. In this case, as the number of cassettes increases, the structure of the cables may become complex.

FIG. 1 is a block diagram illustrating the configuration of a conventional cassette detection device.

Referring to FIG. 1, the cassette detection device may include a plurality of cassettes 110, 120, 130, and 140 and a main board unit 190 configured to detect the plurality of cassettes 110, 120, 130, and 140. The main board unit 190 detects whether the plurality of cassettes 110, 120, 130, and 140 are normally mounted in a cassette unit, based on the levels of signals which are applied through detection pins of the connectors 150, 160, 170, and 180 connected to the respective cassettes. Furthermore, the main board unit 190 may display whether the cassettes 110, 120, 130, and 140 are normally mounted, on a display unit (not illustrated).

Referring to FIG. 1, each of a first pin of the first connector 150, a second pin of the second connector 160, a third pin of the third connector 170, and a fourth pin of the fourth connector 180 are connected to a ninth pin of the corresponding connector, and the ninth pin is connected to the ground. At the cassettes 110, 120, 130, and 140, first to fourth pins of the corresponding connector are connected to interrupt pins of a cassette control unit (MCU, not illustrated), and physically connected to fifth to eighth pins thereof, respectively. Furthermore, the fifth to eighth pins are connected to fifth to eighth pins at the main board unit 190, respectively, and connected to pins of a main control unit (MCU) of the system. That is, since the plurality of pins are physically connected to each of the cassettes through cables, the structure of the cassette detection device inevitably becomes complex.

Furthermore, a pull-up resistor (not illustrated) is connected to one side of a pin forming each of the connectors 150, 160, 170, and 180. When the corresponding cassette is not mounted, a signal transmitted to the main board unit 190 basically maintains a high level.

When the cassettes 110, 120, 130, and 140 are normally mounted in the cassette unit, the ninth pins of the respective connectors 150, 160, 170, and 180 may be connected to transmit a low signal to the main board unit 190, in order to detect whether the cassettes are normally mounted on the main board 190. Thus, as illustrated in FIG. 1, the structure of the cables for connecting the cassettes to the main board unit to detect whether the cassettes are normally mounted inevitably become complex.

BRIEF SUMMARY

An embodiment of the present disclosure is directed to a cassette detection device which may be easily manufactured and have a simple circuit configuration.

Another embodiment of the present disclosure is directed to a cassette detection device which transmits a signal based on whether a cassette is mounted through one transmission terminal (pin) regardless of the number of cassettes and detects whether and where the cassette is mounted.

In an embodiment of the present disclosure, a cassette detection device may include: a cassette unit having one or more cassettes mounted therein, the one or more cassettes storing medium therein; a connector unit configured to receive a first signal corresponding to the case in which the one or more cassettes are mounted in the cassette unit or a second signal corresponding to the case in which the one or more cassette are not mounted in the cassette unit, from each of the one or more cassettes through one first transmission terminal; and a main board unit configured to detect one or more of whether and where each of the one or more cassettes is mounted, based on the first or second signal transmitted from the connector unit through a second transmission terminal at a connection position set for each of the one or more cassettes.

In an embodiment of the present disclosure, a cassette detection device may include: a main board unit including a first input unit configured to receive a power supply voltage for varying an output signal according to whether a cassette is mounted and a first connector configured to receive an output signal based on whether the cassette is mounted; and a cassette unit connected to the main board unit, and including a second input unit configured to receive a power supply voltage for varying an output signal according to whether the cassette is mounted, a plurality of switching units corresponding to the number of cassettes and each configured to output a signal which is determined according to a signal of the mounted cassette, and a second connector configured to receive the output signal of the switching unit through one transmission terminal.

BRIEF DESCRIPTION OF THE DRAWINGS

Features, aspects, and embodiments are described in conjunction with the attached drawings, in which.

DETAILED DESCRIPTION

Figure 1:
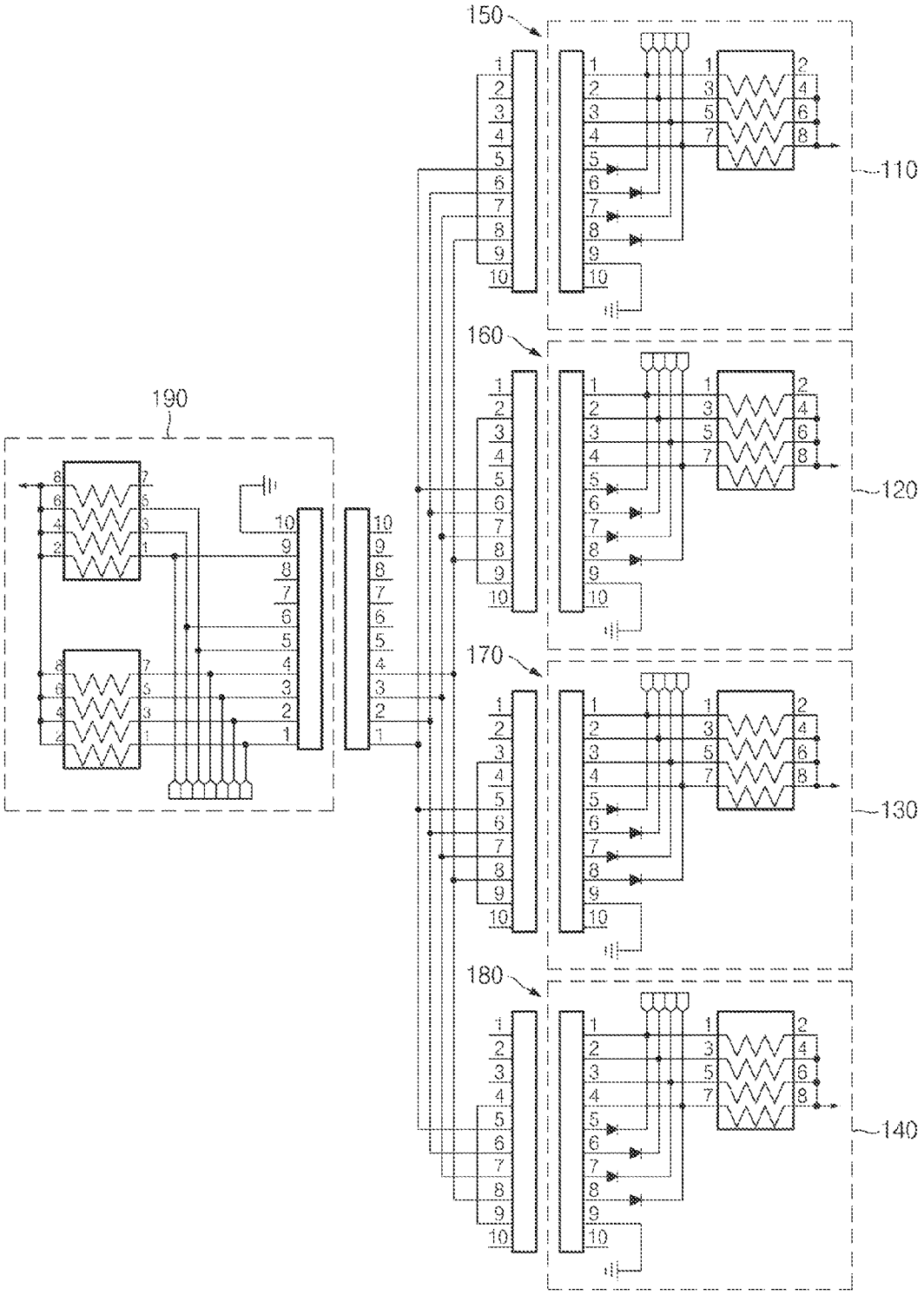
FIG. 1 is a block diagram illustrating the configuration of a conventional cassette detection device.

Hereinafter, exemplary embodiments according to the present disclosure will be described below with reference to the accompanying drawings. When reference numerals are attached to components of the drawings, the components have the same reference numerals even though the components are illustrated in different drawings. Moreover, detailed descriptions related to well-known functions or configurations will be ruled out in order not to unnecessarily obscure subject matters of the present disclosure.

When components in the embodiments of the present disclosure are described, terms such as first, second, A, B, (a), and (b) may be used. Such terms are used only to distinguish between one element and another element, and the properties and sequence or order of the corresponding elements are not limited by the terms. When an element is referred to as being "connected" or "coupled" to another element, the element may be directly connected or coupled to the another element, or indirectly connected or coupled to the another element with another element interposed therebetween.

Hereafter, the embodiments of the present disclosure will be described under the supposition that an automatic teller machine (ATM) is used as an example of a financial apparatus. Such a supposition is only for convenience of description, and the technical idea of the present disclosure is not limited to an ATM.

First, the present disclosure will be briefly described. The present disclosure relates to a cassette detection device. The cassette detection device includes a plurality of cassettes which may be mounted therein and a plurality of switching units corresponding to the number of cassettes, and output signals of the switching units, indicating whether the respective cassettes are mounted, may be inputted to a connector unit or/and a main board unit through one transmission terminal (pin) or/undone connection line (cable), in order to determine whether and where the cassettes are mounted.

Each of the switching units may include an open collector (OC) of which an output signal differs depending on an input signal. The connector unit may be configured to connect two components. Examples of the transmission terminal may include a pin which is used to input/output a signal, data or the like to a component at a relatively short distance, and examples of the connection line may include a cable which is used to input/output a signal, data or the like to a component at a relatively long distance. However, the transmission terminal and the connection line are not limited thereto, but may be configured in various manners.

The switching unit may include a plurality of OCs, for example, and a result signal obtained by performing a logical operation (AND operation) on outputs of the plurality of OCs in each of the cassettes may be inputted to the connector unit and the main board unit through one pin or/and one cable, in order to check whether and where the cassette is mounted. One of the OCs may be connected to each position where the cassette is mounted. In other words, when a cassette is mounted at a specific position, an output signal of an OC corresponding to the position of the mounted cassette may be set to a low level, and an output signal of an OC corresponding to another position may be set to a high level, and vice versa.

In the embodiment of the present disclosure, an open drain (OD) may be used in addition to the OC. The OD is a kind of switching element of which an output terminal (for example, collector or drain) is not connected to a device or the like, and may be substituted for another element having such a function.

The OC is characterized in that the entire output of the OCs becomes low when any one of devices connected to an output of the collector becomes low.

According to the embodiments of the present disclosure, the cassette detection device may include a cassette unit in which a plurality of cassettes may be mounted. The cassette is a kind of box-shaped storage case for storing bills, checks, or the like of a medium handling apparatus.

Figure 2:
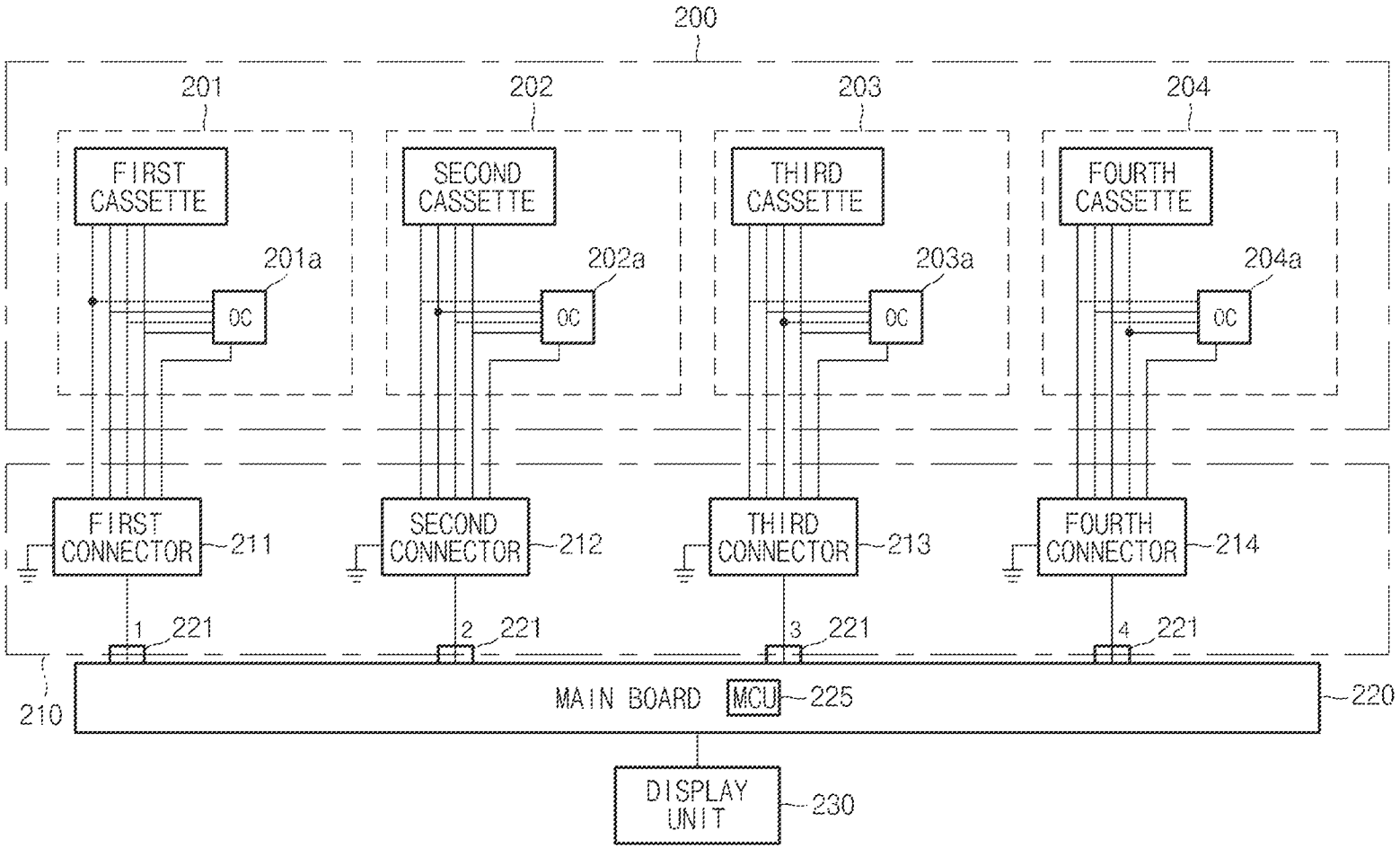
FIG. 2 is a block diagram illustrating the configuration of a cassette detection device according to an embodiment of the present disclosure.

FIG. 2 is a block diagram illustrating the configuration of a cassette detection device according to an embodiment of the present disclosure.

As illustrated in FIG. 2, the cassette detection device according to the embodiment of the present disclosure may include a cassette unit 200, a main board unit 220, a connector unit 210, and a plurality of cables. The cassette unit 200 may include a plurality of cassettes 201, 202, 203, and 204 each storing medium therein. The main board unit 220 may detect whether and where each of the cassettes is mounted, according to an output signal based on the mounting of the cassette in the cassette unit 200. The connector unit 210 may be provided between the cassette unit 200 and the main board unit 220, and include a transmission terminal (for example, pin) to transmit the output signal based on the mounting of the cassette. Each of the cables serves to transmit the output signal based on the mounting of the cassette, and connects the respective units.

The main board unit 220 may include a main control unit (MCU) 225 configured to determine whether and where each of the cassettes is mounted in the cassette unit, based on an output signal transmitted from the cassette unit 200 or/and an output signal of a first input unit (not illustrated). A display unit 230 may display whether and where the cassettes 201, 202, 203, and 204 are mounted, based on the information transmitted from the main board unit 220.

The cassettes 201, 202, 203, and 204 of the cassette unit 200 may include switching units 201*a*, 202*a*, 203*a*, and 204*a*, respectively, of which output signals are switched according to input signals. Each of the switching units 201*a*, 202*a*, 203*a*, and 204*a* may include a plurality of OCs. Each of the switching units 201*a*, 202*a*, 203*a*, and 204*a* may output a low or high signal through the plurality of OCs, the low or high signal indicating a cassette which is mounted in the cassette unit 200 or a cassette which is not mounted in the cassette unit 200. The signal may be inputted to one transmission terminal and then inputted to the main board unit 220 through one connection line. The transmission terminal may include a pin, for example, and the connection line may include a cable. However, the transmission terminal and the connection line are not limited thereto.

The plurality of OCs included in each of the switching unit 201*a*, 202*a*, 203*a*, and 204*a* may correspond to positions at which a cassette can be mounted. When a cassette is mounted at any one position, one signal is outputted according to a logical operation between a signal inputted to an OC connected to the corresponding position among the OCs of the switching unit of the corresponding cassette and a signal inputted to the other OCs. According to the characteristic of the OC, when any one of the output signals of the respective open collectors OC is a low signal, the result signal based on the logical operation is set to the low level.

Thus, when the cassette is mounted at any one position of the cassette unit 200, the final output signal of the switching unit corresponding to the mounted cassette may be set to the low level, and the final output signal of the switching unit corresponding to the unmounted cassette may be set to the high level. Then, the final output signal of the switching unit corresponding to the mounted may be set to the low level, inputted to a connector of one transmission terminal (pin), and inputted to a transmission terminal (pin) of the main board unit 220 through one cable.

In the embodiment of the present disclosure, the result signal for the output signals of the OCs is set to the low level, when any one of the output signals becomes low. For example, when any one of the output signals becomes low, the result signal may be set to the low level, and vice versa.

Figure 3:
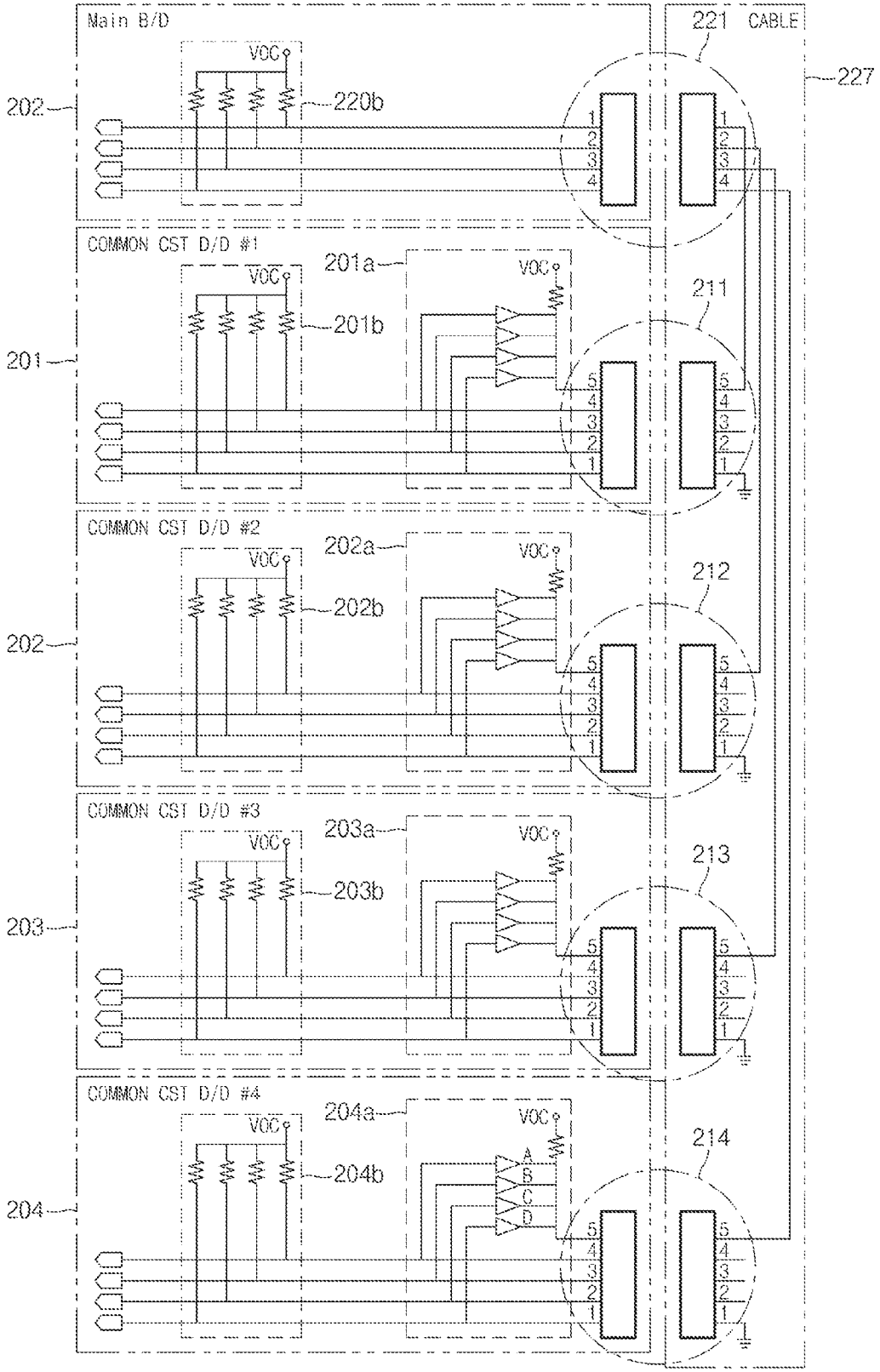
FIG. 3 is a circuit diagram of a cassette detection device according to an embodiment of the present disclosure.

FIG. 3 is a block diagram illustrating the configuration of a cassette detection device according to an embodiment of the present disclosure.

First, the cassette detection device according to the embodiment of the present disclosure includes a cassette unit, a plurality of switching units, and a main board unit. The cassette unit includes a plurality of cassettes of which each stores medium therein. Each of the switching units is configured to output a low or high signal corresponding to a cassette which is mounted in the cassette unit or a cassette which is not mounted in the cassette unit. The main board unit receives a result signal for the signal outputted through the switching unit through one or more of one transmission terminal (pin) and one connection line (cable).

For example, the cassette unit according to the embodiment of the present disclosure may include a plurality of trays (not illustrated) in which the respective cassettes can be mounted. Each of the trays has a unique number. The final result signal of the corresponding switching unit, is inputted/outputted through one pin (for example, fifth pin) of a connector connected to the main board unit, and inputted to a pin of the main board unit, corresponding to the tray, through one cable. Thus, it is possible to determine on which tray the cassette is mounted.

The number of OCs or ODs included in each of the cassettes may correspond to the number of trays (positions) of the cassette unit.

Each of the switching units outputs a low signal indicating whether a cassette is mounted in the cassette unit and a high signal indicating whether no cassette is mounted in the cassette unit, and the result signal (low or high signal) is inputted to a connector connected to the cassette unit through one transmission terminal (pin).

The result signal is inputted to a connector connected to the main board unit through one connection line (cable).

When the cassette is mounted in any one tray of the cassette unit, an output signal of the OC of the switching unit corresponding to the tray having the cassette mounted therein becomes low, and an output signal of the OC of a switching unit corresponding to a tray having no cassette mounted therein becomes high. Furthermore, the value of a logical operation between the signals becomes low, and is inputted to the connector unit and the main board unit through one or more of one pin and one cable.

Thus, when the cassette is mounted, the final output signal of the switching unit corresponding to the mounted cassette becomes low, and the final output signal of the switching unit corresponding to the unmounted cassette becomes high according to a pull-up resistor. Each of the output signals of the switching units corresponding to the mounted cassette and the unmounted cassette is inputted to transmission terminals (pins) of the connector unit and the main board unit, which correspond to the mounted cassette, through one or more of one pin and one cable which correspond to the switching unit.

A cassette detection device according to an embodiment of the present disclosure may include a main board unit and a cassette unit. The main board unit may include a first input unit configured to receive a power supply voltage for varying an output signal according to a signal based on whether a cassette is mounted; and a first connector configured to receive a signal of a mounted cassette. The cassette unit may be connected to the main board unit, and include a second input unit configured to receive a power supply voltage for varying an output signal according to whether the cassette is mounted; a plurality of switching units corresponding to the number of cassettes and each configured to output a signal which is determined according to the signal of the mounted cassette; and a second connector configured to receive the output signal of the switching unit through one transmission terminal.

Referring to FIG. 3, the cassette detection device according to the embodiment of the present disclosure may be included in a medium handling apparatus. The following descriptions will be focused on the cassette detection device.

The cassette detection device may include a main board unit 220 and a plurality of cassettes 201, 202, 203, and 204. The main board unit 220 may detect whether and where one or more cassettes are mounted, and output the detection result to the display unit 230 of FIG. 2. The plurality of cassettes 201, 202, 203, and 204 may include switching units 201*a*, 202*a*, 203*a*, and 204*a* connected to the main board unit 20, respectively, and store medium therein.

The positions at which the plurality of cassettes 201, 202, 203, and 204 are mounted may be determined through the connectors 211, 212, 213, and 214 connected to output signals of the switching units 201*a*, 202*a*, 203*a*, and 204*a*, which are based on signals generated from second input units 201*b*, 202*b*, 203*b*, and 204*b* through an external input, respectively. The positions at which the plurality of cassettes 201, 202, 203, and 204 are mounted may be determined based on the output signals from the connectors 211, 212, 213, and 214 are inputted to the pins indicating mounted position of the plurality of cassettes 201, 202, 203, and 204.

The external input may include a power supply voltage Vcc or Vdd which is applied to the switching units 201*a*, 202*a*, 203*a*, and 204*a* connected to the second input units 201*b*, 202*b*, 203*b*, and 204*b* and a first input unit 220*b* connected to the switching units 201*a*, 202*a*, 203*a*, and 204*a*, but is not limited thereto.

The power supply voltages Vcc/Vdd applied to the respective units may be equal to each other or different from each other.

The main board unit 220 may include a connector 221 for connecting to the plurality of cassettes 201, 202, 203, and 204. The connector 221 may include a plurality of pins corresponding to the positions of trays on which the respective cassettes are mounted. Furthermore, each of the pins may be connected to a cable 227. The cable 227 may be connected to the cassettes 201, 202, 203, and 204 through the respective connectors 211, 212, 213, and 214.

The main board unit 220 may include a first input unit 220*b* configured to generate a high/low signal based on an input signal of the connector 221. According to the signal outputted from the first input unit 220*b*, the control unit 225 of the main board unit 220 may determine whether and where the plurality of cassettes are mounted.

The plurality of cassettes may include the switching units 201*a*, 202*a*, 203*a*, and 204*a* connected to the respective second input units 201*b*, 202*b*, 203*b*, and 204*b* and configured to output a low or high signal indicating a mounted cassette or unmounted cassette. The result signal for the signal outputted through each of the switching units 201*a*, 202*a*, 203*a*, and 204*a* is inputted to the corresponding connector through one transmission terminal of the corresponding cassette, for example, the fifth pin. However, any other pin may be used.

The cassette unit according to the embodiment of the present disclosure may include a plurality of trays on which the respective cassettes are mounted. Each of the trays has a unique number. The final result signal of the corresponding switching unit, is inputted/outputted through one pin (for example, the fifth pin in FIG. 3) of the connector connected to the main board unit, and inputted to a pin of the main board unit, corresponding to the tray, through one cable. Thus, it is possible to determine on which tray the cassette is mounted.

That is, each of the trays may be connected to the corresponding connector which receives a signal outputted from the switching unit of the corresponding cassette, and the each connector is connected to the pins of main board unit 220 indicating a unique number (i.e. mounted position) corresponding to the tray. Thus, when a signal outputted from the cassette is inputted to the connector, the main board unit connected to the connector may determine on which tray the cassette is mounted, through the signal inputted to the connector.

For example, the cassette mounted on the first tray may determine that the cassette is mounted on the first tray, and the cassette mounted on the second tray may also determine that the cassette is mounted on the second tray. The number of trays is only an example, and may correspond to the number of cassettes, that is, four. However, the number of trays is not limited thereto. The tray may correspond to a cassette unit.

In the conventional cassette detection device, the connector must include a plurality of pins (for example, four pins) corresponding to the number of cassettes, in order to determine whether the cassettes are mounted. In the present embodiment, however, since the output signal of each switching unit and the result signal are inputted to the connector through one pin, the structure of the cassette detection device may be simplified regardless of the number of cassettes.

The signal inputted to the one pin of the connector may be inputted to the pin of the main board unit, corresponding to the cassette, through the cable, in order to determine whether and where the cassette is mounted. The detailed circuit configuration and operation for detecting a cassette will be described below with reference to FIG. 4.

Figure 4:
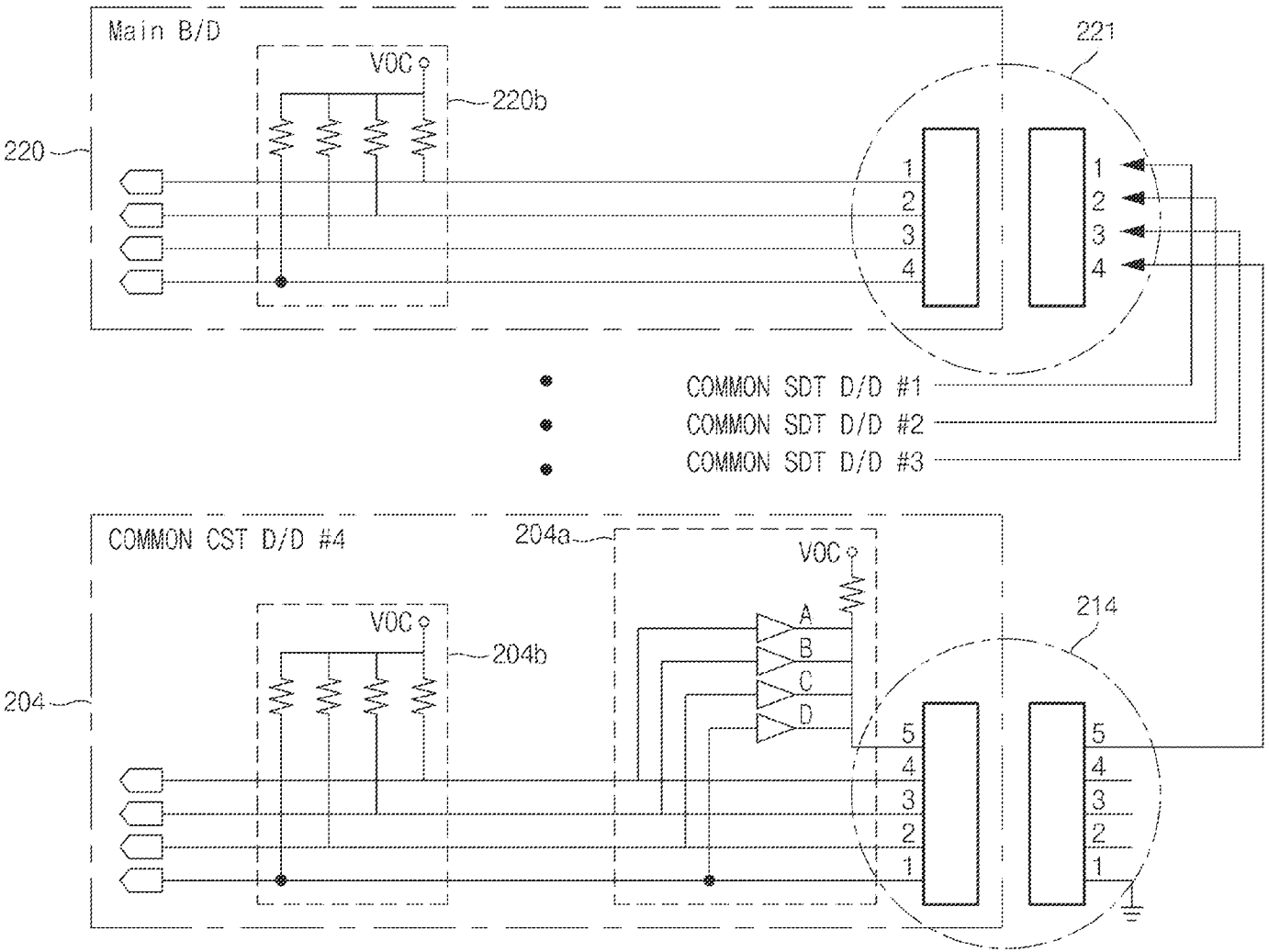
FIG. 4 is a circuit diagram illustrating a part of the cassette detection device according to the embodiment of the present disclosure.

FIG. 4 is a circuit diagram illustrating a part of the cassette detection device according to the embodiment of the present disclosure. That is, FIG. 4 illustrates the main board unit 220 and the fourth cassette 204 which is one of the plurality of cassettes 201, 202, 203, and 204.

According to the embodiment of the present disclosure, the cassette detection device may determine whether a cassette is mounted, and transmit a signal to the main board unit 220 to check whether and where the cassette is mounted.

Referring to FIG. 4, when a cassette is mounted in the cassette unit which can include four cassettes 201, 202, 203, and 204, an output signal of the cassette is connected to the ground and becomes low (0V).

Thus, when the fourth cassette 204 is mounted to any tray, a power supply voltage (5V) applied to the second input unit 204*b* and an output signal of OC corresponding to a mounted position of the fourth cassette based on the operation of the pull-up resistor become low (0V), and output signals of OCs corresponding to a not mounted position of the other cassettes 201, 202, and 203 become high (5V).

Each of the output signals may be inputted to the switching unit 204*a* of the corresponding tray.

The switching unit 204*a* may output a signal which is determined according to the input signal based on whether the corresponding cassette is mounted, the applied power supply voltage (5V), and the operation of the pull-up resistor. An output signal of a switching element corresponding to the tray mounted the fourth cassette is connected to the ground and becomes low (0V), and output signals of the other switching elements A, B, and C corresponding to other trays not mounted cassettes become high (5V).

Thus, according to the characteristic of the switching unit 204*a*, the result signal for the output signals of the switching elements becomes low. Then, the result signal is inputted to one pin (fifth pin) of the connector 214 and then inputted to the corresponding pin (fourth pin) of the connector 221 of the main board unit 220 through the cable. The main board unit 220 may recognize that the fourth cassette is mounted to the fourth tray of the cassette unit 200 through the input low signal, the power supply voltage (5V) applied to the first input unit 220*b*, and the low signal outputted on the basis of the pull-up resistor.

The descriptions of the operation for the fourth cassette may be applied to operations of determining whether the other cassettes are mounted.

So far, the cassette detection device according to the embodiment of the present disclosure has been described. The present disclosure may be applied to a medium handling apparatus which includes the above-described cassette detection device so as to store or discharge medium.

According to the embodiments of the present disclosure, the plurality of cassettes may determine where the cassettes are mounted, and the main board unit connected to the respective cassettes may also determine the positions of the cassettes thereon. Furthermore, since the plurality of cassettes and the main board unit forming the medium processing device have a similar and simple circuit configuration, the medium processing device may be easily manufactured, and the manufacturing cost may be reduced.

Furthermore, the cassette detection device may be easily manufactured and have a reduced number of processing errors. In particular, the cassette detection device may transmit a signal based on whether a cassette is mounted through one transmission terminal (pin) for each cassette, regardless of the number of cassettes. Thus, the structure of the cables for connecting the cassettes and the connectors may be simplified.

Although it has been described that all of the components forming the embodiments of the present disclosure are combined and operated as one system or method, the present disclosure is not limited to the embodiments. That is, all of the components may be selectively combined and operated as one or more systems or methods within the scope of the present disclosure. Furthermore, all of the components may be implemented as one independent hardware component, but a part or all of the components may be selectively combined and implemented as a computer program having a program module to perform a part or all of functions combined in one or more hardware components. Also, functional programs, codes, and code segments forming the computer program can be easily construed by those skilled in the art to which the present disclosure pertains. The computer program may be stored in computer readable medium and read and executed by a computer, thereby accomplishing the embodiments of the present disclosure. The storage medium for the computer program may include magnetic recording medium, optical recoding medium, carrier wave medium and the like.

Furthermore, when it is described that one "comprises" (or "includes" or "has") some elements, it should be understood that it may comprise (or include or has) only those elements, or it may comprise (or include or have) other elements as well as those elements if there is no specific limitation. The terms including technical or scientific terms have the same meanings as the terms which are generally understood by those skilled in the art to which the present disclosure pertains, as long as they are differently defined. The terms defined in a generally used dictionary may be analyzed to have meanings which coincide with contextual meanings in the related art. As long as the terms are not clearly defined in this specification, the terms may not be analyzed as ideal or excessively formal meanings.

While certain embodiments have been described above, it will be understood to those skilled in the art that the embodiments described are by way of example only. Accordingly, the device described herein should not be limited based on the described embodiments. Rather, the device described herein should only be limited in light of the claims that follow when taken in conjunction with the above description and accompanying drawings.

What is claimed is:

1. A cassette mounting detection device comprising:

a cassette unit comprising a plurality of trays on which at least one cassette is mounted;

a connector unit configured to receive a first signal indicating that the at least one cassette has been mounted on at least one of the plurality of trays of the cassette unit or a second signal indicating that the at least one cassette has not been mounted on the plurality of trays of the cassette unit through a first transmission terminal of each tray of the plurality of trays; and a main board unit configured to detect whether the at least one cassette has been mounted on at least one of the trays and on which tray of the plurality of trays of the cassette unit the at least one cassette has been mounted based on the first or second signal transmitted from the connector unit through a second transmission terminal, wherein the first and second signals are static;

wherein either the first signal or the second signal is outputted as an output signal from each of the plurality of trays, wherein each output signal is directly transferred to the main board unit through the connector unit, wherein each of the at least one cassette comprises:

an input unit configured to receive a power supply voltage that varies the first and second signals according to whether the at least one cassette has been mounted on the plurality of trays; and a switching unit configured to generate the first or second signal based on the power supply voltage, wherein the switching unit comprises a plurality of open collectors (OC) corresponding to the trays on which the at least one cassette is mounted.

2. The cassette mounting detection device of claim 1, wherein each of the trays is matched with the first transmission terminal.

3. The cassette mounting detection device of claim 1, wherein when one cassette of the at least one cassette is mounted on one tray of the plurality of trays, the cassette is connected to a ground such that a first output signal of the OC corresponding to the tray on which the one cassette has been mounted becomes a low level, a second output signal of the OC corresponding to trays that no cassette has been mounted on becomes a high level, and the first signal generated through a logical operation between the first and second output signals becomes a low level and is transmitted to the connector unit through the first transmission terminal.

4. The cassette mounting detection device of claim 3, wherein when the one cassette is mounted on the tray, the input unit is connected to the ground such that an output signal thereof becomes the low level, a first output signal of the OC corresponding to the trays that no cassette has been mounted on becomes the low level, a second output signal of the OC corresponding to the trays that no cassette has not been mounted on becomes the high level based on a pull-up resistor, and the first signal generated through a logical operation between the first and second output signals of the OCs becomes the low level and is transmitted to the connector unit through the first transmission terminal.

5. The cassette mounting detection device of claim 1, wherein the main board unit further comprises:

a connector configured to receive the first or second signal through the second transmission terminal.

6. The cassette mounting detection device of claim 5, wherein the main board unit detects whether the cassette has been mounted on a tray, when the first signal is received through the connector, and detects on which tray of the plurality of trays the cassette of the at least one cassette has been mounted according to the second transmission terminal which receives the first signal.

7. The cassette mounting detection device of claim 1, wherein the connection unit comprises at least one connector corresponding to the at least one cassette, respectively.

8. The cassette mounting detection device of claim 1, wherein the first transmission terminal and the second transmission terminal are electrically connected to each other.

9. The cassette mounting detection device of claim 1, wherein the first signal comprises a low-level signal, and the second signal comprises a high-level signal.

10. A cassette mounting detection device comprising:

a main board unit comprising a first input unit configured to receive a power supply voltage for varying an output signal according to whether a cassette of at least one cassette is mounted on a tray and a first connector configured to receive an output signal based on whether the cassette is mounted on the tray; and a cassette unit connected to the main board unit, and comprising a second input unit configured to receive a power supply voltage for varying the output signal according to whether the cassette is mounted on the tray, a plurality of switching units respectively corresponding to the at least one cassette and each switching unit of the plurality of switching units configured to output a signal that is determined according to a signal of a mounted cassette, and a second connector configured to receive the output signal of the switching unit through one transmission terminal, wherein the cassette unit has the at least one cassette, the at least one cassette storing medium therein, wherein the output signal is directly transferred to the main board unit through the first connector and the second connector, wherein the output signal is static, and wherein each of the plurality of switching units comprises a plurality of open collectors (OC) corresponding to the tray on which the at least one cassette is mounted.

* * * * *